US006736209B2

(12) United States Patent
Ivannikov et al.

(10) Patent No.: US 6,736,209 B2
(45) Date of Patent: May 18, 2004

(54) METHOD FOR VIBRATIONAL IMPACT ON A PIPE STRING IN A BOREHOLE AND DEVICES FOR CARRYING OUT SAID METHOD

(75) Inventors: Vladimir Ivanovich Ivannikov, Moscow (RU); Ivan Vladimirovich Ivannikov, Moscow (RU)

(73) Assignee: BIP Technology Ltd., Limassol (CY)

( * ) Notice: Subject to any disclaimer, the term of this patent is extended or adjusted under 35 U.S.C. 154(b) by 0 days.

(21) Appl. No.: 10/276,364

(22) PCT Filed: May 15, 2001

(86) PCT No.: PCT/RU01/00193

§ 371 (c)(1),
(2), (4) Date: Apr. 25, 2003

(87) PCT Pub. No.: WO01/88329

PCT Pub. Date: Nov. 22, 2001

(65) Prior Publication Data

US 2003/0168212 A1 Sep. 11, 2003

(30) Foreign Application Priority Data

May 16, 2000 (RU) ..... 2000111933

(51) Int. Cl.[7] ..... E21B 43/00

(52) U.S. Cl. ..... 166/249; 166/178; 166/177.6; 166/286; 166/301; 175/56; 175/106; 175/298

(58) Field of Search ..... 166/249, 178, 166/177.6, 286, 301; 175/293, 296, 297, 299, 55, 56, 106, 298

(56) References Cited

U.S. PATENT DOCUMENTS 4,462,471 A * 7/1984 Hipp ..... 175/296
4,702,315 A 10/1987 Bodine
4,747,466 A * 5/1988 Jaworski ..... 181/120
4,958,691 A * 9/1990 Hipp ..... 175/296
5,582,247 A 12/1996 Brett et al.
5,997,172 A * 12/1999 Wakabayashi ..... 366/124
6,062,324 A * 5/2000 Hipp ..... 175/296
6,571,870 B2 * 6/2003 Zheng et al. ..... 166/178

FOREIGN PATENT DOCUMENTS

| | | |
|---|---|---|
| RU | 1802076 A1 | 3/1993 |
| SU | 945386 A | 7/1982 |
| SU | 953183 | 8/1982 |
| SU | 1051233 | 10/1983 |

* cited by examiner

*Primary Examiner*—Roger Schoeppel
(74) *Attorney, Agent, or Firm*—Collard & Roe, P.C.

(57) ABSTRACT

The invention relates to well construction and is directed at an oscillation excitation in a pipe string. According to the inventive method, an operating fluid is circulated in the pipe string. An autonomous mechanism for vibrational impact embodied in the form of an element, for instance a hollow ball having a rigid envelop and filled with gas, possessing a positive floatability, covering from 0.85 to 0.95 of a cross-sectional flow area of the pipe string and having an unrestricted degree of freedom. In the second variant, the inventive device comprises a ball support embodied in the form of a transverse beam or a crossbar rigidly connected to a spiral cylindrical spring arranged inside a tube under the ball with the aid of an easy-push fit. The spring force is selected with respect to a calculated axleload dependence on the mass of the ball and on flow strength with a basic flow rate of the operating fluid. A lateral oscillation is actuated simultaneously with a displacement of the mechanism for vibrational impact inside the pipe string. When the flow rate of the operating fluid exceeds the basic flow rate, the mechanism for vibrational impact is displaced towards the bottom of the well and when flow rate of the operating fluid decreases with respect to the basic flow rate, the mechanism for vibrational impact is displaced towards the well cellar. The invention reduces a friction force during displacement inside the well, precludes sticking and performs vibration impact on the fluid medium filling the well.

7 Claims, 1 Drawing Sheet

METHOD FOR VIBRATIONAL IMPACT ON A PIPE STRING IN A BOREHOLE AND DEVICES FOR CARRYING OUT SAID METHOD

CROSS REFERENCE TO RELATED APPLICATIONS

Applicants claim priority under 35 U.S.C. §119 of Russian Application No. 2000111933 filed May 16, 2000. Applicants also claim priority under 35 U.S.C. §365 of PCT/RU01/00193 filed May 15, 2001. The international application under PCT article 21(2) was not published in English.

FIELD OF USE

This invention relates to construction of wells and is intended to produce vibrations in the string of tubes to reduce friction drag when it moves in the borehole, to free a stuck pipe and also to provide vibrational action on liquids that are filling the well.

PRIOR ART

A method is known to excite elastic oscillations in a well and a device therefor [USSR Certificate of Authorship no. 953183, 16.09.1980]. It comprises a moving element in the form of a ball that is placed into a string of tubes in a well, which ball transversely oscillates when pumping a liquid and due to this it hits the wall of the said tubes and thus transfers the oscillations to the string of pipes. The axial motion of the ball is limited by a support that is rigidly fixed at some location inside the tubing string.

These method and device can be considered as a prior art analog to the proposed invention. One can refer to the following general shortcomings of this analog:

- Action of the device is localized in certain cross-section of the string of pipes since there is a stopper of axial motion of the working element;
- The support (stopper of axial motion) made in the form of a grid adds surplus hydraulic resistance and induces vortexes in the fluid flow: the first results in additional losses of hydraulic power, the second affects stability of the knocker operation.

A device is also known [USSR Certificate of Authorship no. 1051233, 30.07.1982] for cementing of a casing pipe in a well which device comprises a string of pipes having a cement baffle collar at its shoe and which is filled with working fluid, and a driving plug with a vibrations generating mechanism placed on it. This the vibrations generating mechanism is equipped with a float fixed on it which float can be separated from the said driving plug once it sets on the cement baffle collar. The vibrations generating mechanism consists of a battery, switching unit and a float.

This device works as follows. After the computed volume of cement slurry was pumped into the casing pipe, a driving plug is run into it carrying the vibrations generating mechanism, battery, switching unit and a float. The switching unit turns on the vibrations generating mechanism when the cement rises in the annulus to a required level, for example, when cement level in the annulus and depth of said mechanism coincide. While this mechanism moves down to the cement baffle collar and then up to the well mouth it excites in the casing pipe the elastic oscillations which are transferred into the annulus where they act on the cement slurry there.

Due to this device a method is realized of vibrational action on a string of pipes which method comprises placing into the pipe string of a self-sustained mechanism for vibrational action, pumping into the string of pipes of working fluid and transportation with this fluid of the said mechanism for vibrational action and simultaneous exciting of transverse vibrations in the string.

This device and method which it implements are the most relevant to the proposed ones by technical realization and therefore they are selected as a prototype.

Main shortcomings of the prototype are as follows:

- complexity of the vibrations generator design and a need in autonomous power supply;
- narrow specialization, i.e. it is intended for vibrational action during cementing of casing pipe with a driving plug and float valve;
- possibility is absent to controllably vary the intensity of oscillations because it is determined by the executive mechanism and said autonomous power supply;
- vibrational action can be performed only single time starting from the moment of separation of the vibroactuator from the driving plug and only in one direction—from bottom hole to mouth of the well.

DESCRIPTION OF THE INVENTION

The proposed method of vibrational action on a string of tubes in a well comprises placement in the tubing string of an autonomous mechanism of vibrational action, pumping into the tubing string of a working fluid and transporting with it of the mechanism of vibrational action and simultaneous exciting by it of transverse oscillations of tubes in the string, where direction of transportation of the mechanism of vibrational action, frequency and amplitude of the tubes oscillations, and duration of the treatment within particular depth interval in the string of pipes are controlled by the working fluid pumping rate. Before placement of the mechanism of vibrational action into string of pipes a reference washing liquid pumping rate shall be firstly determined at which the transportation speed of the mechanism of vibrational action is equal to zero. The direction of transportation of mechanism of vibrational action is set in respect of this reference pumping rate, i.e. at higher working fluid pumping rate values comparing the reference one the mechanism of vibrational action is transported down to the bottom hole, and at working fluid pumping rate values lower than the reference one the mechanism of vibrational action is transported up to the well mouth. And vibrational treatment of selected interval of the tubing string is performed at either the working fluid reference pumping rate or higher or lower pumping rates, or at alternating such working fluid pumping rates.

The first embodiments of the device for vibrational action on a string of tubes in a well comprises the tubing string filled with the working fluid and a mechanism of vibrational action on the tubing string which mechanism is made as an element with positive floatability in said working fluid which element closes 0.85–0.98 of the tubing string cross-section area and can freely move in flow of the working fluid. In particular, mechanism of vibrational action can be made in form of a hollow ball which rigid casing is filled with a gas.

Thickness of wall of the hollow ball can be determined from condition of its floatability by the following formula:

$$t \cong \frac{1}{3} \cdot \frac{\rho_{liq}}{\rho_{met}} \cdot R$$

where:

$\rho_{liq}$—specific gravity of the working liquid;

$\rho_{met}$—specific gravity of ball casing metal;

R—radius of a ball.

Hydrodynamic force acting on the ball in working fluid flow can be derived from the following equation:

$$F = 2\pi\rho_{liq} v^2 R^2 \left\{ \ln\left[ \frac{1}{1 - \left(\frac{R}{R_T}\right)^2} \right] - \frac{R^2}{R_T^2} \right\}$$

where:

v—speed of liquid flow in the tube;

$R_T$—inner radius of the tube.

This force will keep the hollow ball suspended at same position and have it transversely vibrating, which vibrations will be transferred via hits on the wall to the string of pipes. Frequency and strength of these hits will vary depending on degree of closing of the tube cross-section. When speed of the fluid flow is increased the oscillating ball will move down, and when speed of the fluid flow is decreased the oscillating ball will move up counterflow.

As the laboratory test shown the hollow ball radially oscillates and the plane of vibrations rotates.

Another embodiment of the device for vibrational action on a string of tubes in a well comprises the tubing string filled with the working fluid and a mechanism of vibrational action on the tubing string which mechanism is made in form of a ball which closes 0.85–0.98 of the tubing string cross-section area, and a ball support made in form of a transverse bar or cross which support is rigidly connected with a cylindrical coil spring placed below the ball and having sliding fit to the tube, and force of the spring is selected accounting the axial load due to weight of the ball and hydraulic pressure by the flow presenting at the said working fluid reference pumping rate.

When the fluid flows around the ball the ball transversely oscillates and due to hits excites vibrations in the tube. To move the mechanism into another location downflow the fluid pumping rate shall be reduced below the reference value. Due to this the spring is released and the knocker, which continues to operate, moves toward bottom hole. For reverse motion of the knocker mechanism—to the well mouth, direction of working fluid flow shall be changed to opposite.

BRIEF DESCRIPTION OF DRAWINGS

The invention is illustrated by drawings.

Figure 1:
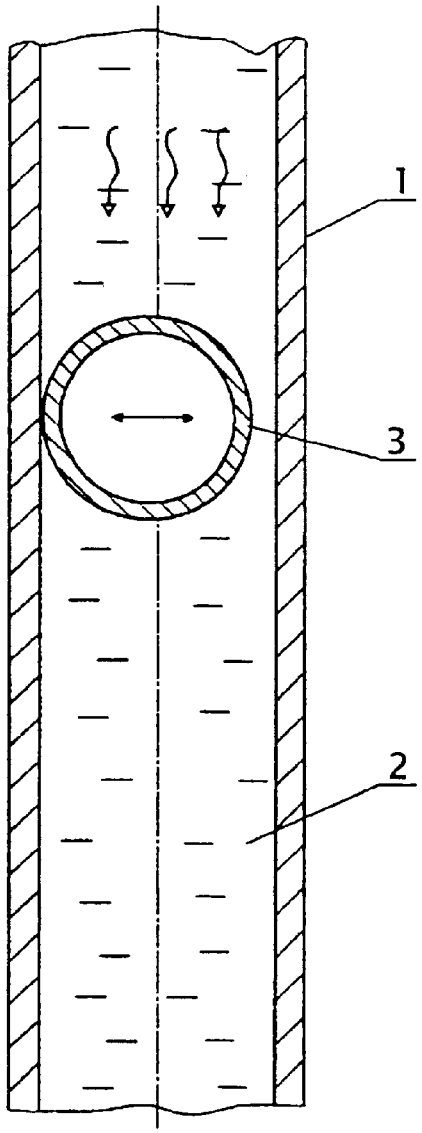
FIG. 1 shows cross-section of the first embodiment of the device.

The first device comprises a string of tubes (1) filled with the working fluid (2), for example water, and inside of this string of tubes a hollow ball (3) is placed which rigid casing is made of titanium and filled with a gas, for example air.

The second device comprises a string of tubes (1) filled with the working fluid (2), and inside of this string of tubes a ball (4) is placed which is made, for example, from metal. Under the ball a support (5) for it is placed made, for example, in form of a transverse cross and which support is rigidly connected with a cylindrical coil spring (6).

When the fluid flows down to bottom hole as shown by arrows and if the speed of the working fluid flow exceeds the reference one, the spring (5) brakes due to friction of the spring coils against tube wall, compresses and broadens thus holding the ball in the required cross-section of the tubing string. And when fluid flows around the ball the ball transversely oscillates and due to hits excites vibrations in the tube.

VARIANTS OF THE INVENTION EMBODIMENTS

Figure 2:
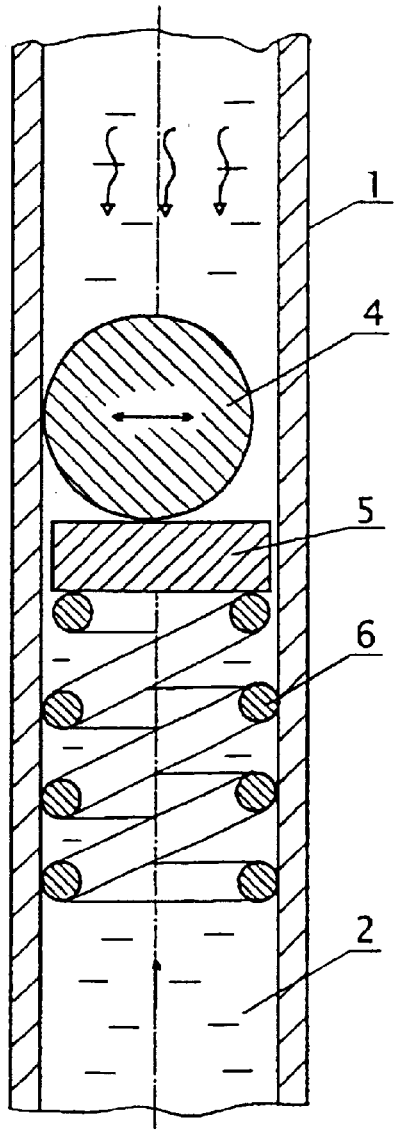
FIG. 2 shows cross-section of the second embodiment.

Method and devices shown in the FIGS. 1 and 2 can be implemented in strings of tubes having uniform inner diameter, for example, in strings of drilling pipes with external ends upset, tubing strings, coil tubing, etc.

Devices 1 and 2 shall be preliminary tested to determine the reference pumping rate value when the particular actuator of transverse vibrations of tubes is suspended at the same position. After that a dependence of its transportation speed shall be determined as a function of the working fluid pumping rate (higher and below the reference one) for given type and size of the tubes in the string. Then the device is placed into the tubing string descended into a well and filled with a working fluid (water, oil, drilling fluid, cement slurry, chaser fluid, etc.) and the fluid pumping is switch on according to certain program. Upon finish of works in the well the mechanism of vibrational action can be removed from the well either by floating or reverse circulation of the fluid or along with the tubing string.

TECHNICAL APPLICABILITY

Main advantages if the proposed method and devices for vibrational action on a tubing string in a well comparing the stationary mounted vibrations source are as follows:

- In case of a stuck pipe, for example, sticking of them to the wall of the well one can position the vibrator at the sticking point and thus achive faster freeing of the stuck pipe;
- Possibility is provided of multiple and specific vibrational action on the string of pipes along its entire length what is important, for example, to reduce friction drag or improve cleaning of boreholes of complicated course, and especially of the well laterals;
- Simplicity and readily controlling the work of mechanism of vibrational action via change of pumping rate;
- Possibility is provided to control intensity of vibrational action via variation of diameter of the ball knocker and working fluid pumping rate;
- Possibility is provided to simultaneously employ several such devices to maintain vibrations along the entire length of the tubing string, for example, to reduce friction drag in horizontal wells.

What is claimed is:

1. Method of vibrational action on a string of tubes in a well comprising placement in the tubing string of an autonomous mechanism of vibrational action, pumping into the tubing string of a working fluid and transporting with it of said mechanism of vibrational action and simulataneous exciting of transverse oscillations of pipes in the string, wherein the direction of transportation of the mechanism of vibrational action, frequency and amplitude of the tubes oscillations, and duration of the treatment within particular depth interval of the string of pipes are controlled via the working fluid pumping rate.

2. Method of vibrational action on a string of tubes in a well of claim 1, wherein before placement of the mechanism of vibrational action into string of pipes a reference working liquid pumping rate shall be firstly determined at which the transportation speed of the mechanism of vibrational action is equal to zero, and direction of transportation of the mechanism of vibrational action is set in respect of this reference pumping rate, when higher working fluid pumping rate exceeds the value of the reference one the mechanism of vibrational action is transported down to the bottom hole, and when working fluid pumping rate is lower than the reference one the mechanism of vibrational action is transported up to the well mouth.

3. Method of vibrational action on a string of tubes in a well of claim 2, wherein vibrational treatment of selected interval of the tubing string is performed at the working fluid reference pumping rate.

4. Method of vibrational action on a string of tubes in a well of claim 2, wherein vibrational treatment of selected interval of the tubing string is performed at the working fluid pumping rate higher or lower than reference pumping rate, or at alternating such working fluid pumping rates.

5. Device for vibrational action on a string of tubes in a well comprising a tubing string filled with the working fluid and a mechanism of vibrational action on the tubing string wherein the said mechanism of vibrational action is made in form of an element with positive floatability in said working fluid which element closes 0.85–0.98 of the tubing string cross-section area and can freely move in the flow of the working fluid.

6. Device for vibrational action on a string of tubes in a well of claim 5, wherein said mechanism of vibrational action can be made in form of a hollow ball which rigid casing is filled with a gas.

7. Device for vibrational action on a string of tubes in a well comprising a tubing string filled with the working fluid and a mechanism of vibrational action on the tubing string wherein the said mechanism of vibrational action is made in form of a ball which closes 0.85–0.98 of the tubing string cross-section area, and a ball support made in form of a transverse bar or cross which support is rigidly connected with a cylindrical coil spring placed below the ball and having sliding fit to the tube, and force of the spring is selected accounting the axial load due to weight of the ball and hydraulic pressure by the flow at the said working fluid reference pumping rate.

* * * * *